US006282764B2

(12) United States Patent
Ruiz et al.

(10) Patent No.: US 6,282,764 B2
(45) Date of Patent: Sep. 4, 2001

(54) PROCESS FOR PERSONALIZING A MOUNTING PLATE

(75) Inventors: Manuel Alba Ruiz; Fernando Lopez Diaz, both of Madrid (ES)

(73) Assignee: Fabricas Lucia Antonio Betere, S.A. (Flabesa) (ES)

( * ) Notice: Subject to any disclaimer, the term of this patent is extended or adjusted under 35 U.S.C. 154(b) by 0 days.

(21) Appl. No.: 09/767,288

(22) Filed: Jan. 23, 2001

Related U.S. Application Data

(63) Continuation of application No. 08/840,373, filed on Apr. 28, 1997, now abandoned.
(60) Provisional application No. 60/033,362, filed on Dec. 18, 1996.

(51) Int. Cl.[7] ..... D04H 1/46; B32B 33/00; B32B 31/16

(52) U.S. Cl. ..... 28/107; 28/158; 264/173.11; 264/258

(58) Field of Search ..... 28/107, 103, 108, 28/109, 110, 111, 158; 264/171.1, 173.11, 241, 257, 258; 428/105, 109, 110, 111, 113

(56) References Cited

U.S. PATENT DOCUMENTS

| | | | | |
|---|---|---|---|---|
| 2,840,881 | * | 7/1958 | Bateman | 28/107 |
| 3,122,141 | * | 2/1964 | Crowe, Jr. | 28/107 |
| 4,726,987 | * | 2/1988 | Trask et al. | 28/107 |
| 4,888,234 | * | 12/1989 | Smith et al. | 28/107 |
| 4,948,649 | * | 8/1990 | Hiers et al. | 28/107 |
| 4,985,279 | * | 1/1991 | Mussallem, III | 28/107 |
| 5,149,582 | * | 9/1992 | LaMarca, II et al. | 428/234 |
| 5,388,320 | * | 2/1995 | Smith et al. | 28/107 |
| 5,433,987 | * | 7/1995 | Peterson et al. | 28/107 |
| 5,504,979 | * | 4/1996 | Sheehan et al. | 28/107 |
| 5,546,880 | * | 8/1996 | Ronyak et al. | 28/107 |
| 5,609,707 | * | 3/1997 | Bazshushtari et al. | 28/107 |

FOREIGN PATENT DOCUMENTS

| | | | |
|---|---|---|---|
| 609715 | * | 8/1994 | (EP) . |
| 0 128 52 89 | * | 11/1989 | (JP) . |
| 0 313 04 50 | * | 6/1991 | (JP) . |

* cited by examiner

*Primary Examiner*—Amy B. Vanatta
(74) *Attorney, Agent, or Firm*—Gabriel P. Katona L.L.P.

(57) ABSTRACT

A process for personalizing a mounting plate of a plurality of layers of a mounting plate material and a plurality of layers of fibrous material layered over the layers of mounting plate material, which involves joining the fibrous material layers to the mounting plate material layers by penetrating a predetermined number of wick-like extensions of the fibrous material into the mounting plate material to a predetermined depth in the mounting plate material.

7 Claims, 5 Drawing Sheets

A-B

PROCESS FOR PERSONALIZING A MOUNTING PLATE

This is a continuation of application Ser. No. 08/840,373 filed on Apr. 28, 1997, now abandoned which is based on provisional application No. 60/033,362 filed on Dec. 18, 1996.

FIELD OF THE INVENTION

The present invention relates to a personalization procedure of the hardness, strength and durability of mounting plate or seating structures, with which the characteristics of different areas of the mounting plate base in relation to the specific demands required for each of these areas can be adapted, depending on the specific application of the mounting plate structure.

BACKGROUND

It is a general practice to make mounting plate or seating structures by the combination of a resistant structural damping base and one or more layers within which the central damper or principal element is located, to obtain a block which will result aesthetic appearance and convenient use at the same time.

These layers which are made up of a base of polyuretane which can be normally used for that purpose. Expanded polyurethane is a closed cell material which does not permit transpiration of relatively greater thickness, thus compelling the use of products of reduced thickness which, therefore, will not be able to function satisfactorily in its damping function.

Trying to obviate this problem there have been solution known for establishing the aforementioned damping layers of the mounting plate or seating structures, customarily a two-layer structure, using a layer of expanded polyurethane and a layer of textile and fibrous material which, maintaining the characteristics of the group from the point of view of transpiration, it allows a substantial increase of the base thickness and the damping effect of the same.

Spanish utility patent No. 158,195 of the same applicant, is for a two layer of the mounting plate structure whereby, a part of the textile layer's fibers for the two layer of the mounting plate structure a part of the textile layer's fibers are introduced into the inside of the spongy plastic layer for suitable attachment of the mounting plate structure and these multiple fibers serve as linkage between both layers, to provide the mounting plate structure with a desired suitable stability.

Other Spanish patents, such as No. 382,469, also Spanish utility model No. 289,509, and Spanish patent No. 547,760, describe machinery for creating a suitable linkage between the two layers of the mounting plate structure.

SUMMARY OF THE INVENTION

It has been surprisingly found that the fibrous wicking action at the junction between the two layers, in addition to its fixing function, directly affects the level of stiffness of the mounting plate or seating structures, so that this stiffness increases with increased punching or perforating of the base, and the deeper these punched perforation are.

The core of the present invention is that the punching by the perforating needles is achieved by needles deeply penetrating into the base material, and that they also depend on the number of needles used per surface unit, thereby providing greater or lesser stiffness to the different parts of the mounting plate base, so that for example this stiffness can be made be greater in the marginal or peripheral areas of the plates and in the areas where there is more loading than on the rest of the base surface.

According to another characteristic of the present invention the perforating or punching needles can be inserted at a right angle to the plane of the mounting plate base, or they can be inserted at an inclined position with regard to that plane so that the same number of wicks or multiple fibers inserted in the mounting plate layer, with the same length, stiffness of the structure will be lower as the incline of the angle is increased. Alternatively, a bundle of perpendicular and inclined wicks can be inserted in a combined way as well as bundles of wicks with different degrees of inclination.

With the foregoing consideration, and according to another characteristic of the invention, the mounting plate structure can be stratified with two layers, one of fibrous material and another of spongy or non spongy mounting plate material, or it can also be stratified with a number of layers of the aforementioned materials, properly combined. The fibrous material can even be placed inside of two or more layers of the mounting plate material, in which the punching, for establishing the stiffening wicks can be carried out from either side of the base.

The invention also relates to the arrangement of two layers of fibrous material, which can adopt any combination or arrangement with relation to mounting plate material, by putting both of them on the external surfaces of the layer or layers of the mounting plate material, both in the inside or one in the inside and the other on the outside.

In the case of using more than one fibrous layer, they can be of similar or different nature making use of the different characteristics of these materials with any of the aforementioned combination.

Machines which enable the aforesaid personalization procedure of hardness, strength and durability of mounting plate bases, is also an object of the invention.

Machines of this type are structured starting from a dolly, are assembled upon an appropriate chassis in which many perforations can be made and distributed in a reticulated form. A guide plate with various perforations, which coincide with the dolly's perforations, serve to guide the needles used to turn fibers of the correspondent layers of the fibrous layer into wicks introduced in the spongy layer. With the particularity that the needles are associated with a number of crown-pieces of independent drive, which work, for example, through an hydraulic cylinder of controlled haul, in a way that depending on the specific requirements, in each case, it may be therefore modified at will the number of needles which result efficient, as the position or positions of these and also as the distance covered which is equivalent to the length of the fibrous wicks which furthermore are going to be obtained, or of a power assistance by cams provoking the descent of the needles in a depth adapted to the shape of the cams.

According to another feature of the present invention, it has been foreseen that the crown-pieces are fixed to the corresponding running mechanisms in detachable form, so that they can be substituted by others with greater or lesser density of needles, or with longer or shorter needles.

Finally and according to yet another feature of the present invention, the needle-holder crown-pieces can be assembled upon a mounting plate chassis vertically arranged in the machine or arranged in an inclined position when the fibrous wicks are to be disposed in an inclined position in the foamed layer of the mounting plate base.

In this way, the machine is able to provide the mounting plate base with fibrous wicks which will provide stiffness to it, with any variable length, any direction or any density, in all surfaces of the mounting plate base.

BRIEF DESCRIPTION OF THE DRAWING

To provide a complete description of the present invention and for a complete understanding of the characteristics of this invention, references made to the attached drawing wherein.

DETAILED DISCLOSURE

Figure 1:
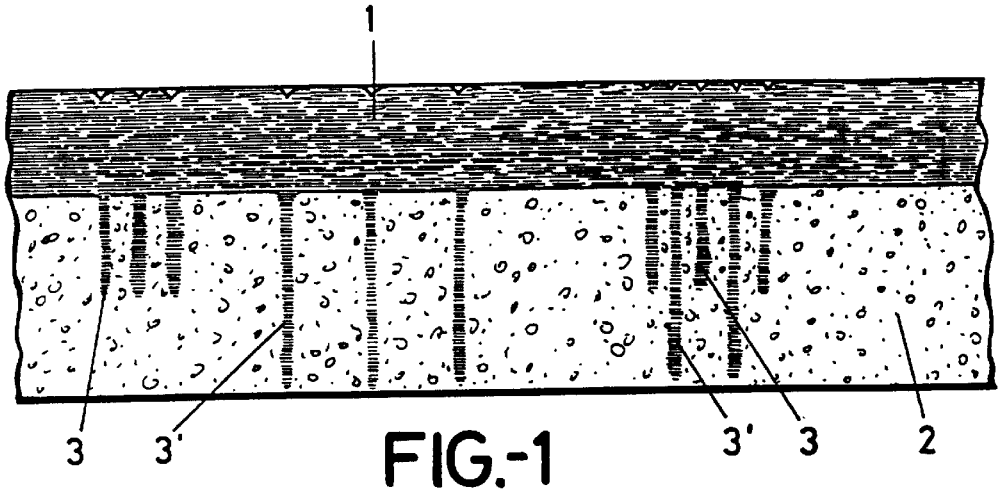
FIG. 1 is a cross-sectional view showing a personalized mounting plate or seating structure made by the process of the present invention.
Figure 2:
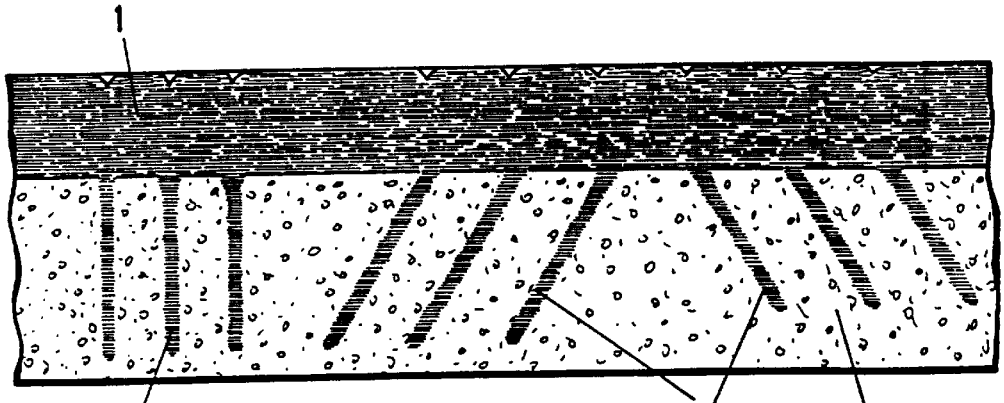
FIG. 2 is a similar view as FIG. 1, wherein the mounting plate has a different arrangement for the stiffening wicks in the base.

As shown in FIGS. 1 and 2, the personalization procedure of the hardness, strength and durability of the present invention is imparted to already formed mounting plates or seating structures of at least two layers, wherein a first layer 1 of fibrous material and a second layer 2 optionally a spongy material, are joined so that both layers are attached to each other by a number of wicks 3 or multiple fibers which emerge from the first layer 1 and which penetrate into the second layer 2, the wicks being disposed and with different density, length, and inclination.

More specifically, the wicks, fibers or multiple fibers 3 can be perpendicular to the horizontal plane of the base, as shown on FIG. 1, with a smaller wick length 3 than the thickness of the second layer 2 of the mounting plate material, with a wick length and a thickness which is approximately combination of wicks of different dimensions, that are suitably grouped or distributed throughout the structure. Depending on the length and density of the wicks or fibers a lesser or greater level of hardness, strength and durability can be achieved for the mounting plate base.

As shown in FIG. 2, the wicks, fibers or multiple fibers 3 not only can have different lengths and densities, but can also have any inclination 3" with relation to the plane of the base.

Figure 3:
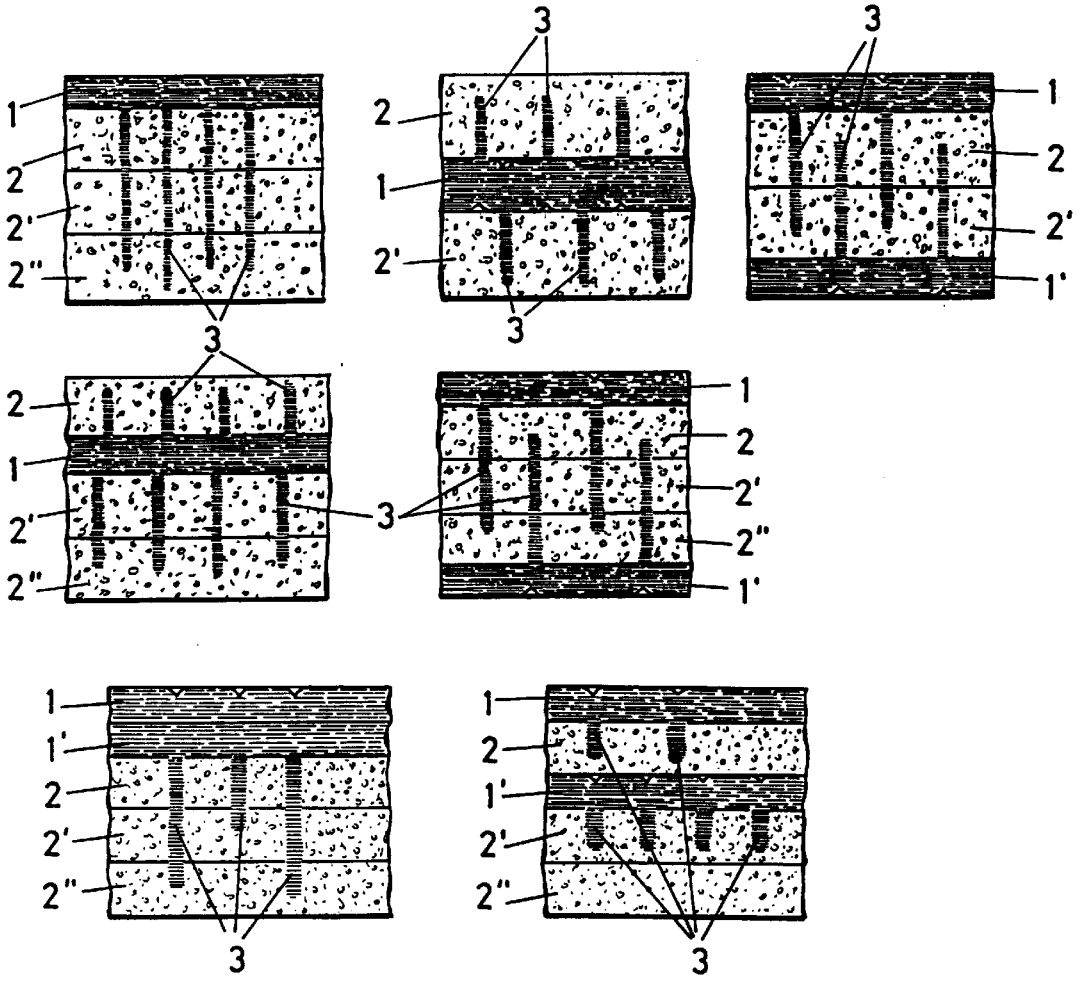
FIG. 3 is shows a variety of additional exemplary illustrations of possibilities of multilayer configurations for the mounting plate with different layers and wicking arrangements.

From this personalization procedure or area control of the hardness, strength and durability of mounting plate or seating structure, it is possible to make 2-layer plates as shown in FIGS. 1–2, or made in multilayer configurations, as shown in FIG. 3.

Particularly in the first image of FIG. 3 where different constructions of the plate structure one of the elements is shown, the first or fibrous layer 1 is suitably of cotton and in the drawings overlay one or more second layers which can be of a different material and can be stiffened with the help of the wicks 3 formed from the material of the first layer. FIG. 3 also shows one first layer 1 of fibrous material, into surrounded by two layers 2, 2' shown in the second image, of the mounting plate material, where to obtain the necessary wicks 3 the first layer has to be punched from both sides to project fibrous wicks from both sides. In the third image of FIG. 3 a stratified base is shown with two first or marginal or external layers 1, 1 of fibrous material and between these there are two second layers 2, 2 of mounting plate material, equally stiffened through the wicks 3. There is also shown in FIG. 3, the fourth image where only a single first layer of fibrous material 1 is inside the mounting plate base, with a second layer 2 of mounting plate material over it and two second layers 2', 2" at the lower side.

In the fifth image of FIG. 3 an alternative for the plate is shown, forming the mounting plate or seating structure, similar to the third image, but with second or intermediate layers 2, 2', 2" of mounting plate material where wicks penetrate from both of the marginal first layers.

In the sixth image of FIG. 7 the plate is made from at least two first layers of fibrous material 1, 1 over the corresponding laminated second layers of mounting plate material 2, 2', 2" and by punching through the latter, the structure can be joined and stiffened, taking into account that the first layers of fibrous material, can be of different characteristics, and at the same time can have complementary characteristics, which allows one to benefit from them.

The seventh and last image of FIG. 3 shows a structure with one of its first layers of fibrous material 1 as the external one while the other first layer is included as a sandwich between layers of second or mounting plate material layers. In this case one or both sides can be punched, because the fibers or wicks of fibers from the external and internal fibrous first layers are taken to the inside of the layers of optionally spongy mounting plate material of the second plates 2, 2'.

Although in FIG. 3, seven different ways have been exemplified, there are many more ways of combining the various layers to be integrated into the seating or mounting plate structures of the present invention.

Figure 4:
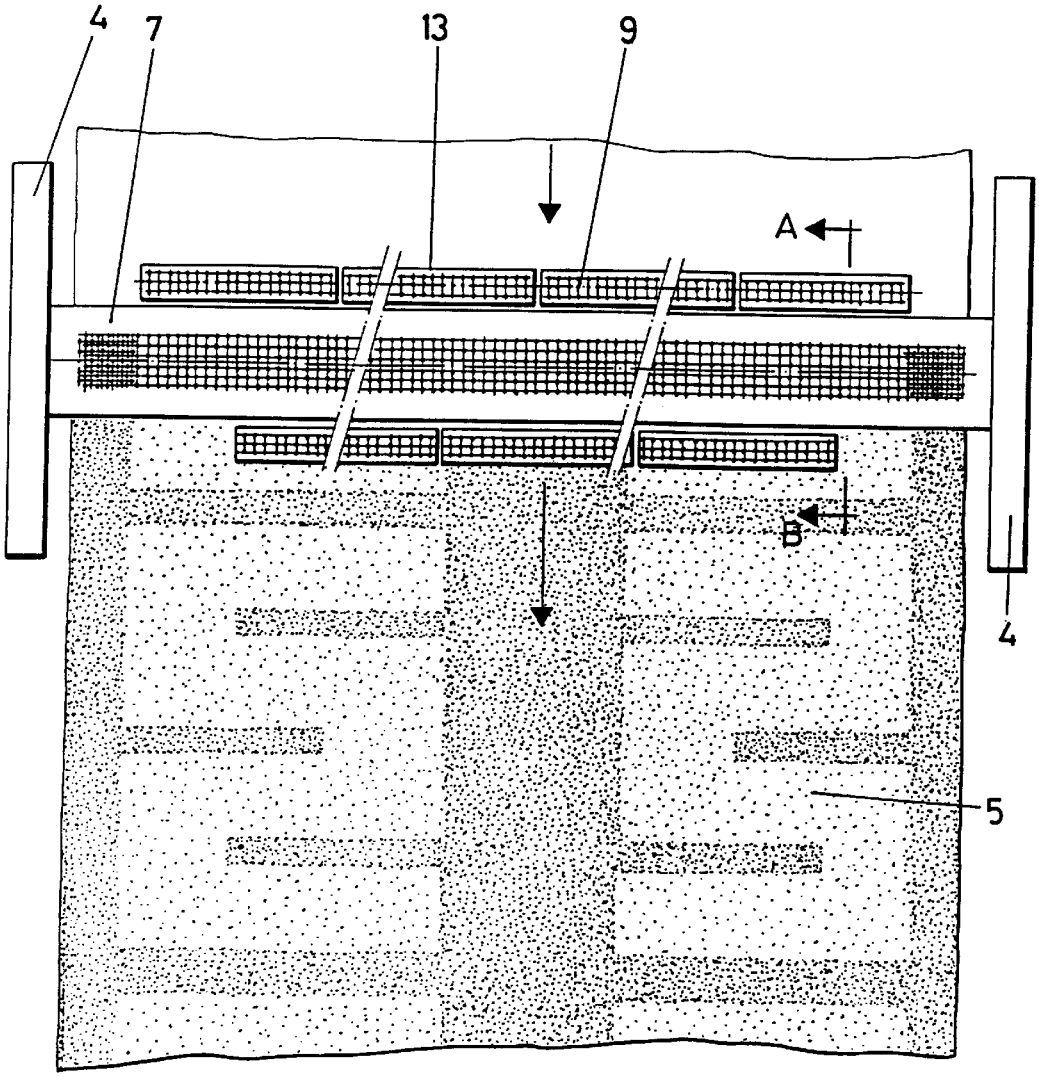
FIG. 4 is plan view of a machine for making mounting plates for making mattresses in accordance with the present invention.
Figure 5:
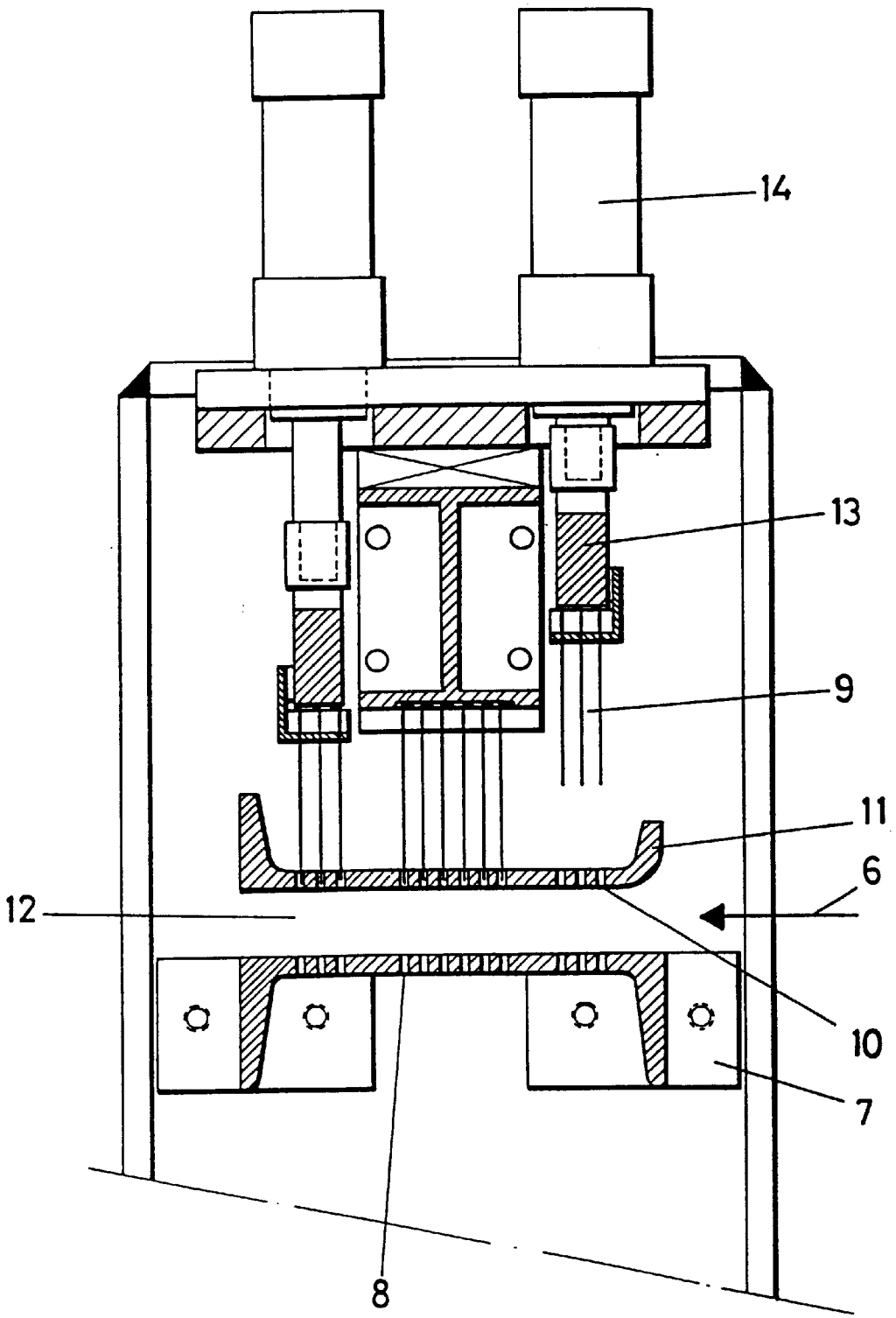
FIG. 5 is an enlarged detail part of a part of the machine of FIG. 4, from a transverse section taken along the line A–B of FIG. 4.
Figure 6:
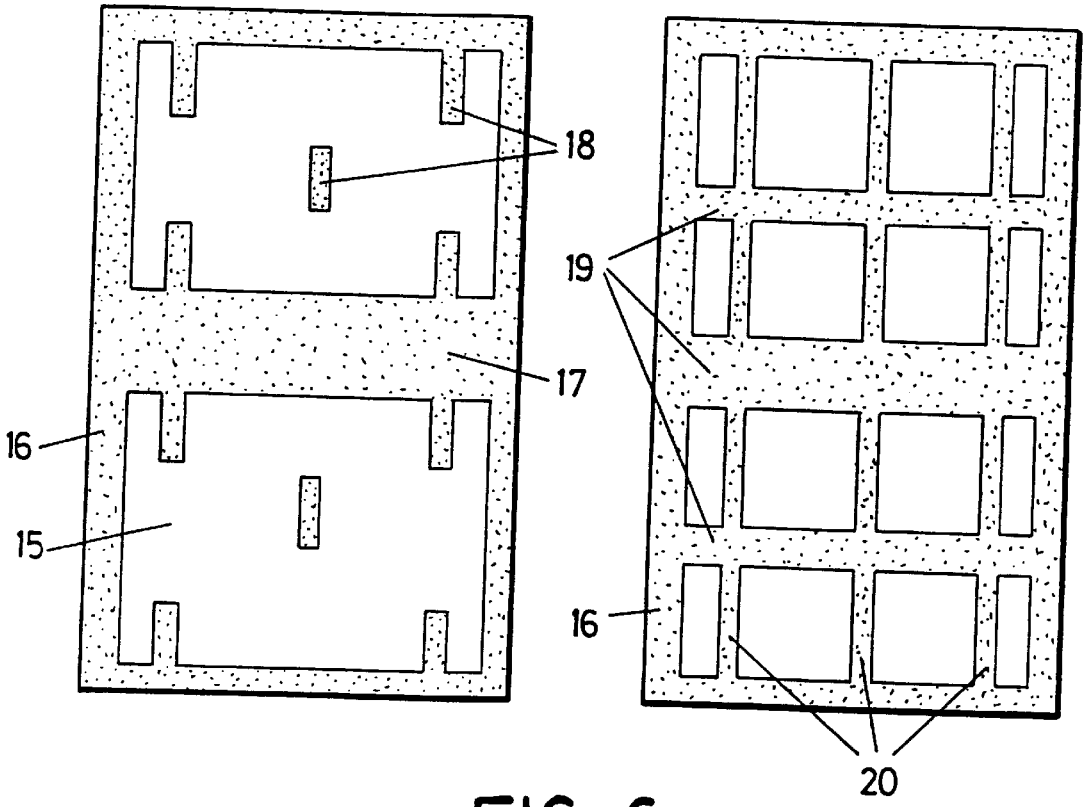
FIG. 6 is a schematic plan view showing two exemplary illustrations of the various possibilities of backing distribution for a mounting plate to be placed into a mattress.

The machine shown in FIGS. 4 to 6, which makes such constructions possible, has a chassis 4, with two lateral supporting stanchions suitably separated from each other so that the mounting plate base 5 in the stiffened phase will be able to fit between them. This mounting plate base, has a stratified structure, with at least one first layer of optionally fibrous material and another, a second layer of mounting plate material superimposed over the first layer, which layers go in the machine through the entrance shown in FIG. 5 with an arrow 6, supported on a dolly 7, situated between the lateral supporting stanchions of the chassis 4. This dolly 7, is provided with a large number of perforations 8 distributed according to the maximum level of perforation foreseen to be made in the mounting plate base with the help of the needles 9. These needles are guided by perforations 10 of a guide 11, which are positioned to coincide with the perforation 8 of the dolly 7 and that over the last one define a pitch 12 for the mounting plate base the needles 9 function to drag along the multiple fibers of the first fibrous layer in form of wicks into the second, suitably spongy layer, making separate fibrous bundles, as it can be seen e.g. in FIG. 5, so that each of these bundles is associated with the needles in a crown-piece (13), that. is independently running driven from the other needles, for example for driven by some actuator, such as a hydraulic cylinder 14, or trough a cam (not shown) when using a powered assistance.

The mounting plate base 5 moves between needle penetrations intermittently through the pitch or piping 12 defined inside of the machine with a magnitude equivalent to the amplitude of the aforesaid piping, in other words equal to the width of the dolly 7 and of the complementary guide 11 and during each stopping of the feed through motion all the needles 9 or at least a part of will be used for punching, with various needles performing a greater or lesser degree of preselected penetration, change the length, quantity and distribution of the fibrous wicks introduced into the second layer or layers of spongy material, shown in FIG. 4, indicated on the mounting plate base 5.

The processing steps of the machine can be totally automated with the aid of a computer program, and there are no limits that can be attained by this method, as exemplified e.g. in FIG. 6. Those exemplary illustrations show mounting plate bases which, in addition to producing a medium degree of stiffness that mostly affects its surface 15, also has a peripheral strip 16 of greater stiffness which is assisted by a wide transverse and median strip 17 on the first case, which longitudinally divides the mounting plate base into two parts and establishes in each of the two halves separate short strips 18 in one embodiment of FIG. 6, and in the second embodiment of FIG. 6 three transverse stiffen strips 19 are shown, which are intersected by three longitudinal and continuous strips 20 that complement the peripheral stiffening strips 16.

What is claimed is:

1. A process for adjusting the stiffness of a mounting plate in furniture seating upholstery or a mattress, of a plurality of layers of a solid firm mounting plate material, and a plurality of layers of fibrous material layered over said layers of mounting plate material, the process comprises joining said fibrous material layers to said mounting plate material layers by penetrating a predetermined number of wick-like extensions of said fibrous material into said mounting plate material to a predetermined depth in said mounting plate material, wherein the number of said wick-like extensions from one fibrous layer is equal or unequal to the number of such extensions from another fibrous layer.

2. The process of claim 1, wherein said joining is accomplished by a predetermined plurality of needles penetrating through said fibrous material layers to extend portions of fibrous material therefrom to a predetermined depth into said mounting material layer, whereby the number and depth of said penetrated wick-like extension into said mounting material layer determine the hardness, strength and durability of said mounting plate structure.

3. The process of claim 1, wherein said wick-like extensions are perpendicular to the surface plane of the mounting plate.

4. The process of claim 1, wherein said wick-like extensions are either perpendicular to, or are disposed at an acute angle or various acute angles to the plane of the mounting plate.

5. The process of claim 1, wherein said wick-like extensions have varying length by which they penetrate into said mounting plate material layer.

6. The process of claims 1, wherein the proximity of said wick-like extensions to each other varies throughout the mounting plate.

7. The process of claim 3, wherein said wick-like extensions penetrate one or more layers according to a predetermined pattern.

* * * * *